US005102267A

United States Patent [19]

Bell et al.

[11] Patent Number: 5,102,267

[45] Date of Patent: Apr. 7, 1992

[54] MACHINE FOR PAVING A CANAL BOTTOM

[76] Inventors: Thomas G. Bell, 608 S. Main St., Ida Grove, Iowa 51445; James N. Ferry, 21575 Bonanza Blvd., Elkhorn, Nebr. 68022; D. William Giroux, 694 Umpqua Pl., LaConner, Wash. 98257; Kendall J. Kelly, 708 Normal, Woodbine, Iowa 51579; Conway P. Narby, 15 Calle Christina, Rancho Santa Margarita, Calif. 92688; Gary L. Patburg, 3701 Mujica Pl., Brea, Calif. 92621

[21] Appl. No.: 522,552

[22] Filed: May 14, 1990

[51] Int. Cl.[5] ..... E02B 5/02

[52] U.S. Cl. ..... 405/268; 404/105

[58] Field of Search ..... 405/116, 222, 223, 268, 405/303; 404/101, 102, 105, 108; 425/59

[56] References Cited

U.S. PATENT DOCUMENTS 2,094,974 10/1937 Wood ..... 405/268
2,827,771 3/1958 Baer ..... 405/268
2,975,602 3/1961 Stromberg ..... 405/268
4,159,890 7/1979 Ogaki et al. ..... 425/59

FOREIGN PATENT DOCUMENTS 71075 2/1983 European Pat. Off. ..... 405/268
2937205 3/1981 Fed. Rep. of Germany ..... 405/268

*Primary Examiner*—David H. Corbin
*Attorney, Agent, or Firm*—Kent A. Herink; Brian J. Laurenzo

[57] ABSTRACT

A canal paving machine is described. The machine comprises an elongated frame which extends transversely across the canal and which is propelled the length thereof while water continues to flow in the canal. A concrete paver is supported on the frame and is designed to lay concrete on one of the sides of the canal and at least a portion of the bottom of the canal as the frame is moved along the length of the canal. Dam members encircle the concrete paving apparatus to protect it from water flowing in the canal during the paving operation.

6 Claims, 8 Drawing Sheets

MACHINE FOR PAVING A CANAL BOTTOM

The present invention relates generally to a machine for applying a concrete layer on a canal bottom and more particularly to a machine for applying the concrete when the canal has water flowing therein.

BACKGROUND OF THE INVENTION

Many irrigation canals are formed with a compacted silt bottom and sloped sides and are prone to water seepage. In those locations where a canal runs through a porous material, serious leakage may take place. One method for repairing such canals is to divert the canal water flow while a concrete layer is being applied to the canal bottom. Some areas, therefore, would be without water during the concrete lining process.

Another method for correcting the canal leakage problem was to construct a new canal having a concrete lined bottom to replace the leaking canal.

It is, therefore, a general object of the present invention to provide a machine for lining a canal with a layer of concrete material while water flows within the canal. Another object is to provide a machine for lining a canal with a concrete material which will not significantly block the normal flow of water in the canal.

A further object of the present invention is to provide a machine for lining a canal with a concrete material which may be continuously operated while the canal is flowing.

SUMMARY OF THE INVENTION

The paving machine is described for applying a concrete layer to the bottom of an irrigation canal while water is flowing in the canal. The machine comprises an elongated frame means which extends transversely across the canal and which has propelling track members at the opposite ends thereof to propel the frame means along the length of the canal. Supported on the frame means is a concrete laying mechanism which is designed to apply a concrete layer on one of the sloped side portions of the canal and an adjacent portion of the bottom of the canal as the frame means is moved in one direction along the length of the canal. Moveable dam or baffle members are provided to shield the concrete laying mechanism from the water flow in the canal during the concrete laying operation.

DESCRIPTION OF THE PREFERRED EMBODIMENT

Figure 1:
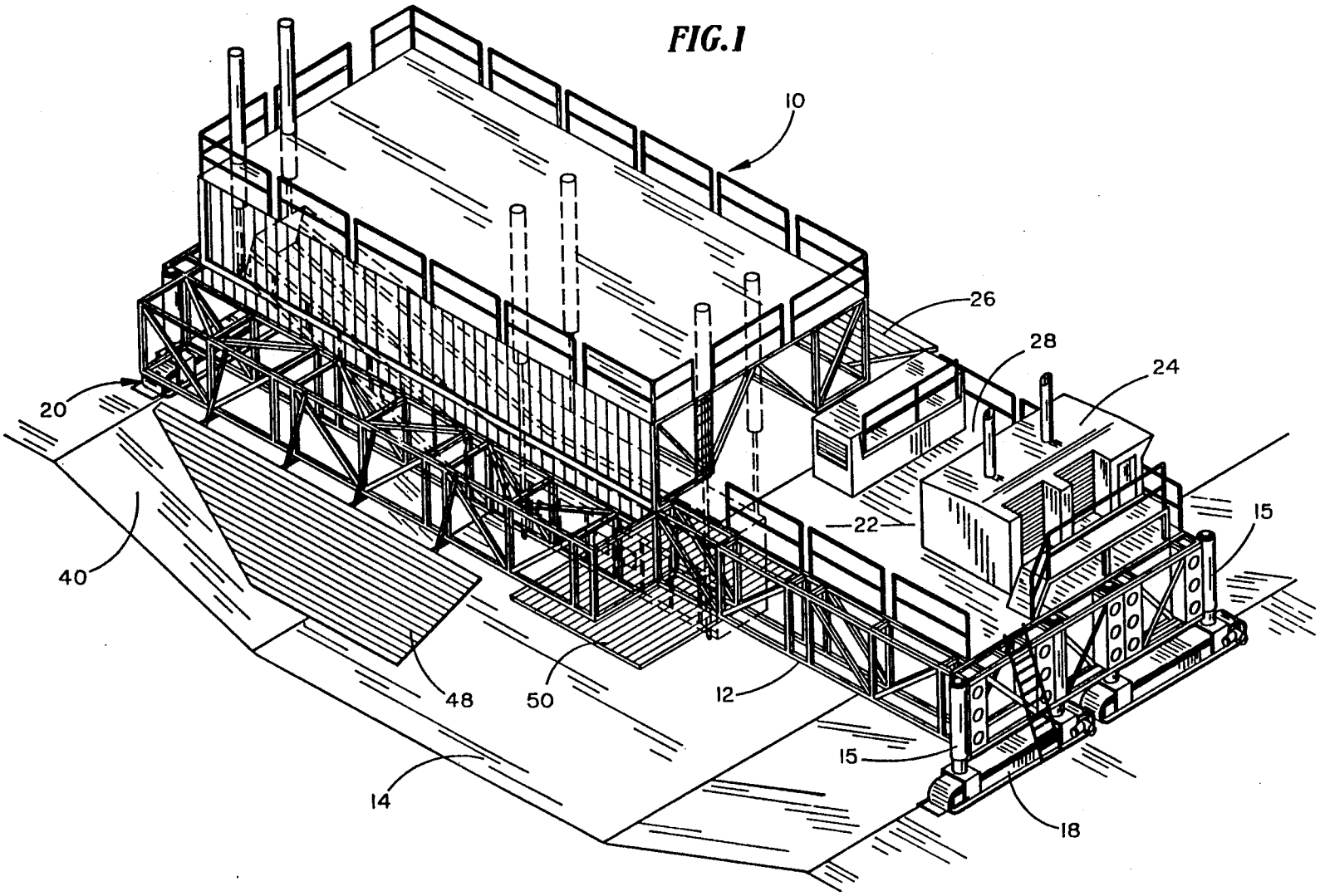
FIG. 1 is a top front perspective view of the canal paving machine of the present invention shown in position transversely across a canal.

Referring to FIG. 1 of the drawings, the canal paving machine of the present invention, designated generally at 10, includes an elongated frame means 12 that extends transversely across a canal 14 having water 16 (FIGS. 2 and 3) flowing therein, and driven endless tracks 18 and 20 at the ends thereof for moving the frame means 12 along the canal 14. Hydraulic cylinders 15 interconnect the frame means 12 and the tracks 18 and 20 and function to raise and lower the frame means 12 relative to the tracks 18 and 20. An upper deck 22 is mounted on the frame means adjacent one end thereof for supporting a power source such as a diesel engine 24 and control console 26 to define an operator station 28 therebetween.

A vertically moveable concrete paving assembly is designated generally at 44 to apply a layer of concrete 46 to the bottom of the canal 14 (FIGS. 2 and 3) Hinged dam members 48, 50, and 52 on the frame means 12 (FIGS. 1–4) hang downwardly like curtains at positions forwardly of, to one side of, and rearwardly of the concrete paving assembly 44, to reduce the flow of water in the concrete laying area of the concrete paving assembly 44 and thereby protect the concrete being applied to the canal bottom from the water current in the canal. The concrete paving assembly 44 is operated from operator's station 28, to continuously apply a concrete layer to approximately one-half of the bottom of the canal 14 on travel of the machine in one direction along the length of the canal.

Figure 5:
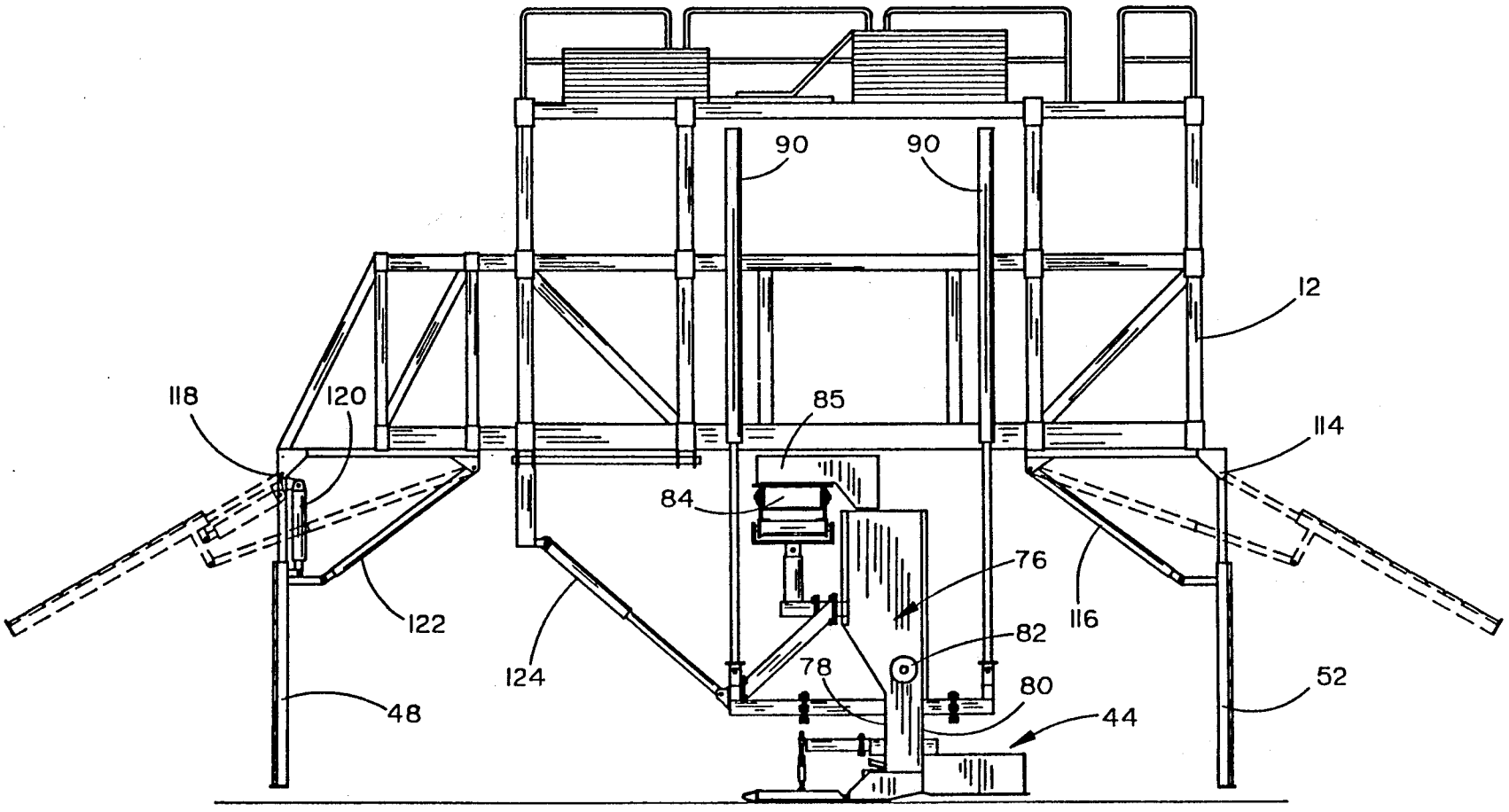
FIG. 5 is a sectional view as seen on line 5—5 of FIG. 3.
Figure 6:
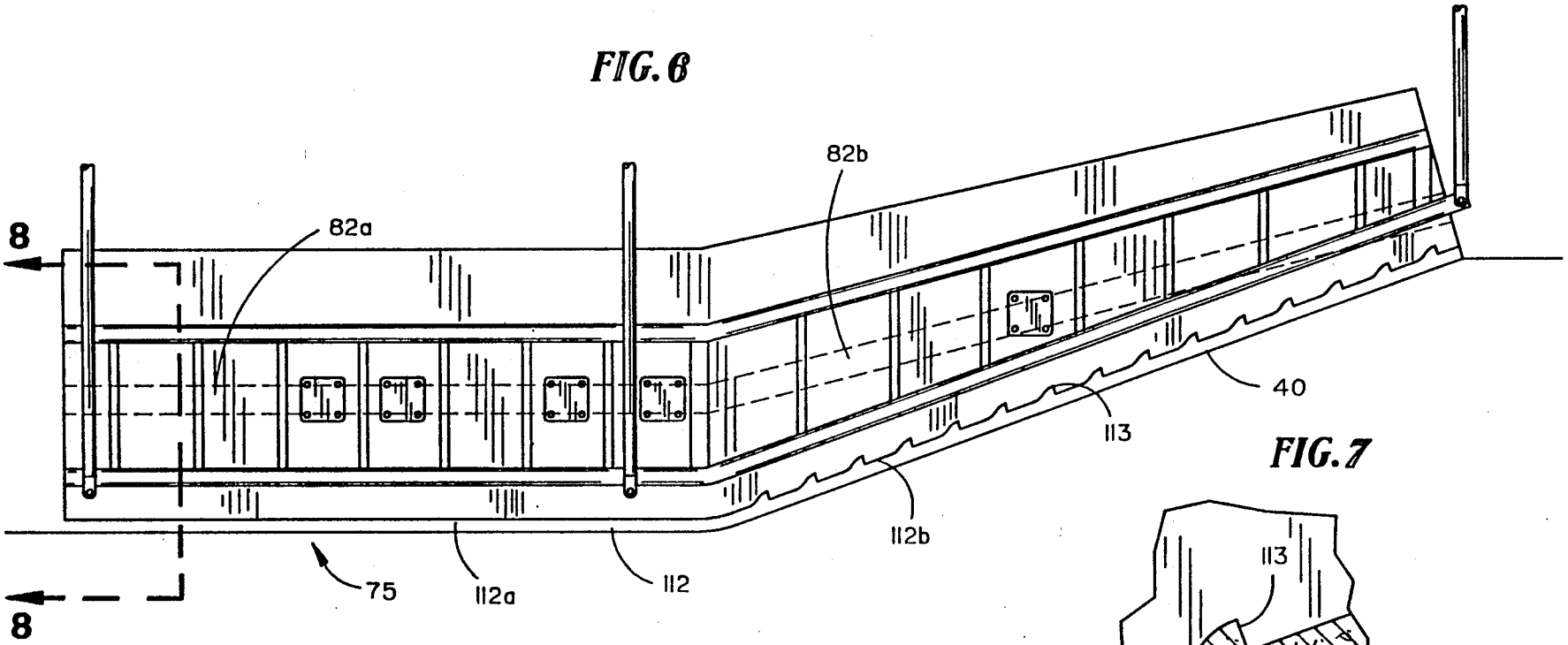
FIG. 6 is a partial enlarged rear elevational view of the concrete laying apparatus.

The canal paving assembly 44 as shown in FIGS. 5, 6, 8, and 9, includes a hopper 76 formed with a forward wall 78 and a rearward wall 80 and having a generally horizontally disposed inner section 75 and an outer upwardly inclined section 77 which follow the confirmation of the canal bottom and adjacent side slope 40 of the canal 14. A series of vertical baffles, one of which is illustrated at 34 in FIG. 9, extend transversely of and in a spaced relation longitudinally of the forward and rearward walls 78 and 80 to help maintain a desired level of the concrete within the hopper 76. An auger 82 (FIGS. 5, 6, and 8) coextensive in length with the hopper 76 and positioned therein above the baffles 34, is operated to move concrete in a direction from the horizontal section 75 upwardly into the inclined hopper section 77 to maintain a selected concrete material head pressure on the concrete within the hopper 76. The auger 82 is comprised of a horizontal auger portion **82*a* and an inclined auger portion 82*b* operatively associated with the hopper sections 75 and 77, respectively. The longitudinal axis of auger portion 82*a*, therefore, is parallel with the bottom of the hopper section 75 along the horizontal portion of the canal bottom. Inasmuch as the water pressure at the bottom of the hopper 76 decreases as the hopper 76 rises along the sloped side wall portion 40, due to the decreasing depth of the water along the slope of the canal, auger portion 82*b* is not disposed parallel to the bottom of the hopper 76, but is inclined with respect thereto as seen in FIG. 6 to maintain the desired concrete head pressure in the hopper section 77**.

Figure 2:
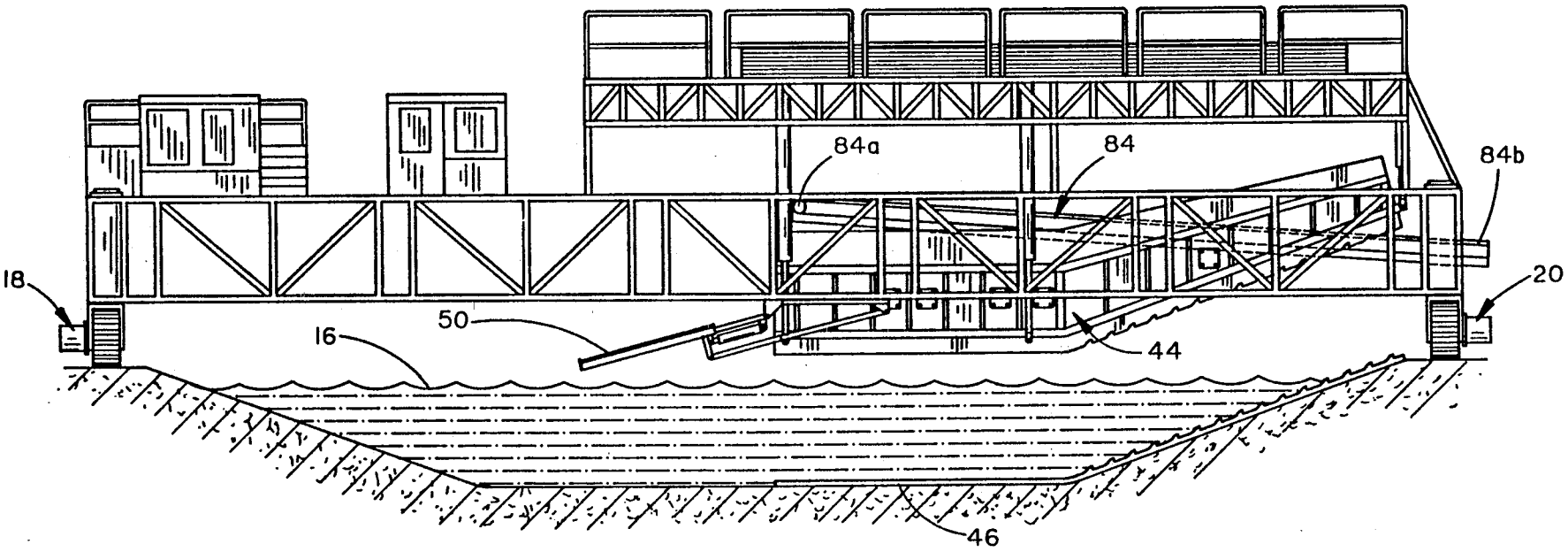
FIG. 2 is a rear elevational view of the canal paving machine showing the concrete laying apparatus raised upwardly above the water in the canal.
Figure 3:
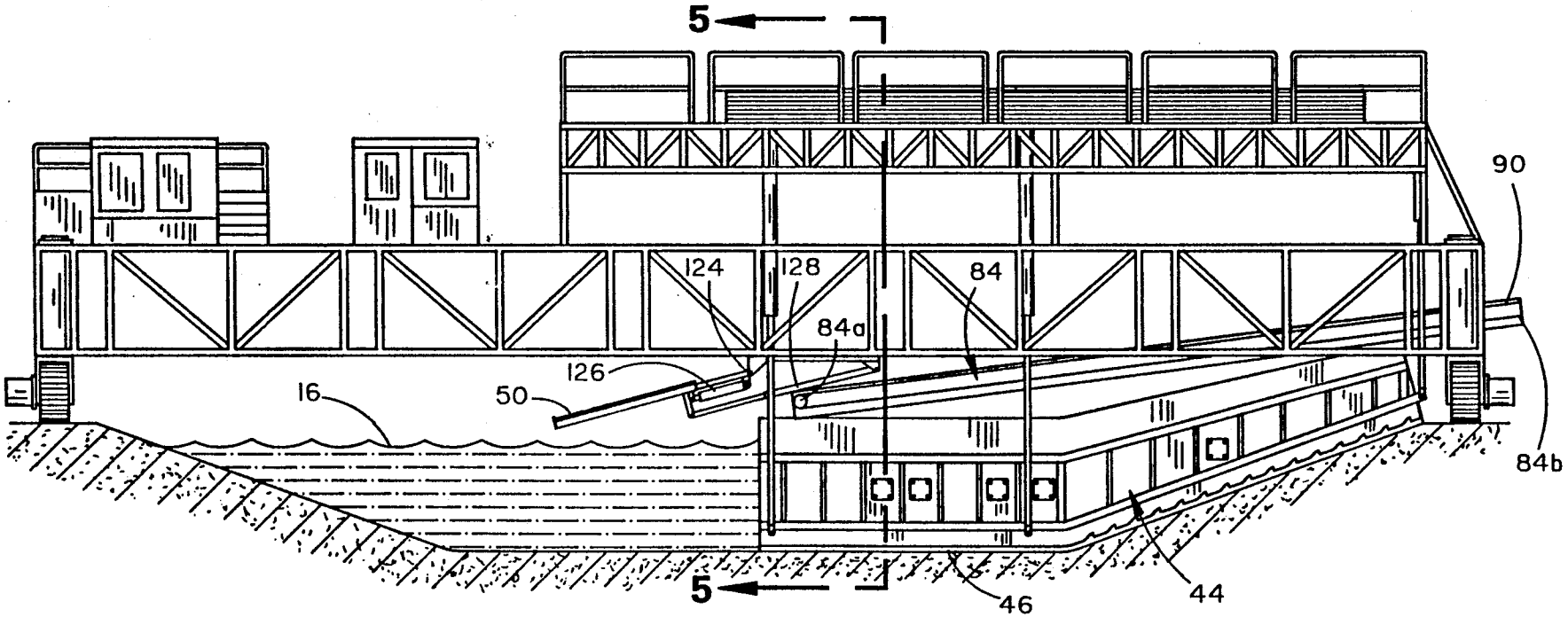
FIG. 3 is illustrated similarly to FIG. 2 and shows the concrete laying apparatus in operative position and the lateral dam member in its raised position.
Figure 4:
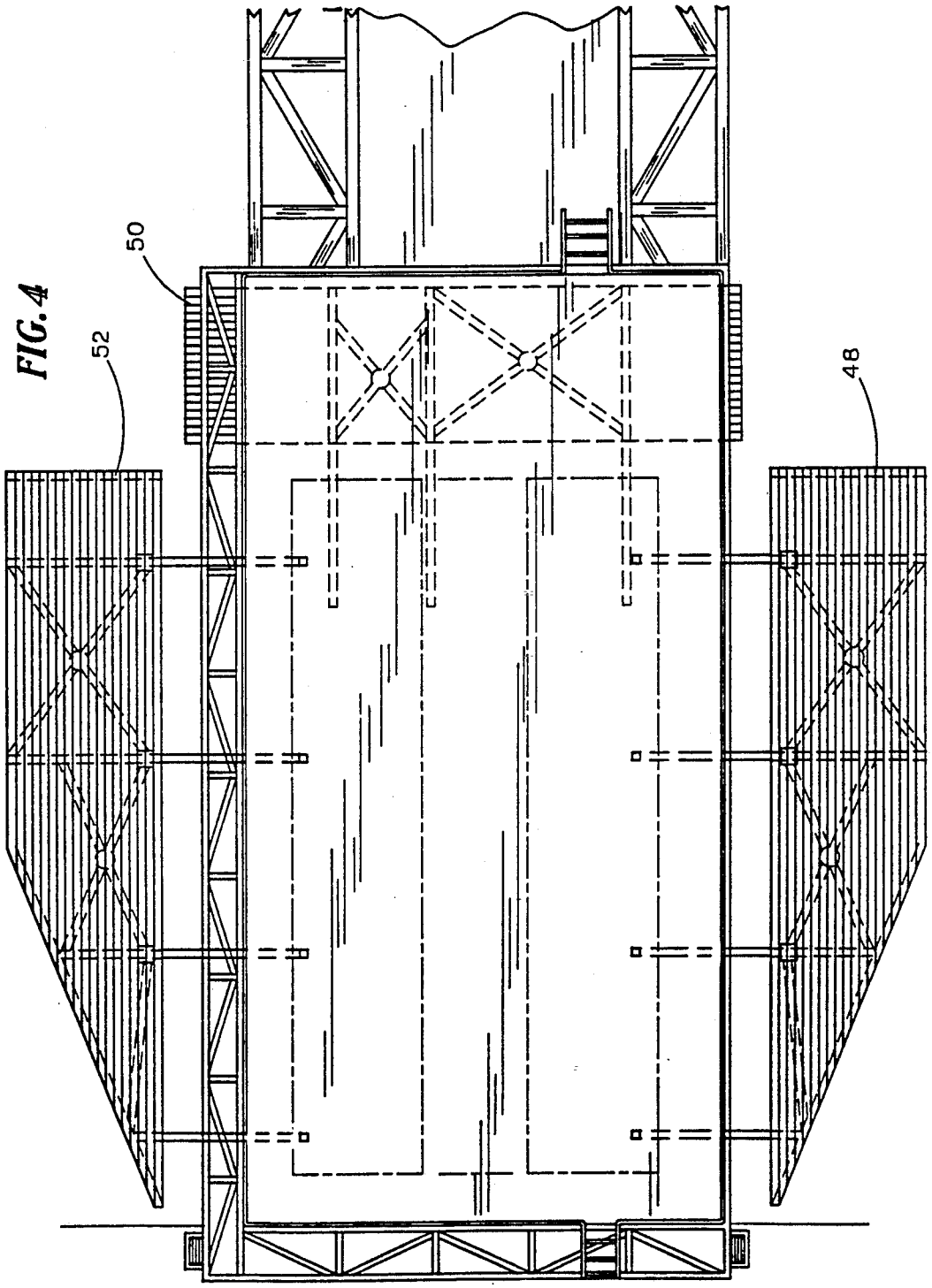
FIG. 4 is a partial elevational top view of the concrete laying apparatus showing the dam members in their raised positions.

A conveyor 84, shown in FIGS. 2 and 3, h-.as an outer end 92 pivoted on the frame means 12 and extends from such outer end through the frame means 12 and inwardly over the length of the hopper 76. Concrete is supplied to the outer conveyor end 92 from trucks or the like. Concrete deposited on the outer end 90 of the conveyor 84 is conveyed toward the inner end thereof. A diverter car 85, mounted for movement longitudinally of the conveyor 84 progressively diverts concrete from the conveyor 84 into the hopper 76.

Hopper 76 (FIG. 5) is supported for up and down vertical movement on the frame means 12 by a plurality of hydraulic cylinders 90. During a concrete applying operation, the hopper 76 will remain at a generally constant level above the canal bottom. However, when a pour of concrete is terminated, the hopper 76 must be raised out of the water to enable the removal of the concrete therein. Raising of the hopper 76 out of the water is also necessary for servicing and maintenance purposes or when the paving machine is manipulated through a 180 degree turn for a reversed travel along the canal to apply a concrete layer to the unfinished half of the canal bottom. Forward and rearward movement of the hopper 76 relative to the frame means 12 is limited by a plurality of cylinders 124 (FIG. 5) which are interconnected between the concrete forming assembly 44 and the frame means 12. The cylinders 124 are adjustable to center and then stabilize the hopper 76 vertically relative to the frame means 12.

Figure 8:
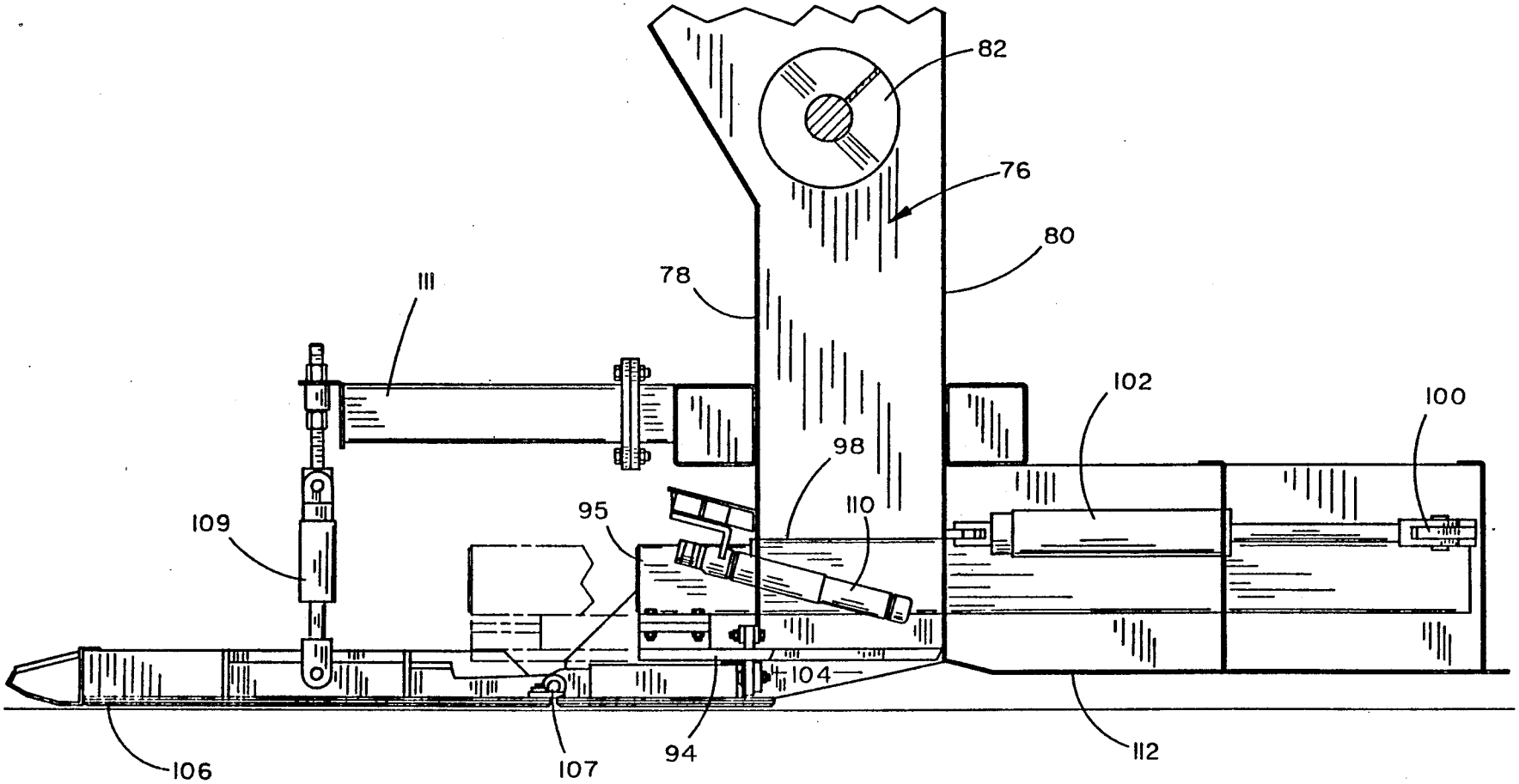
FIG. 8 is a sectional view as seen on line 8—8 of FIG. 6 and showing the hopper assembly of the concrete laying apparatus.
Figure 9:
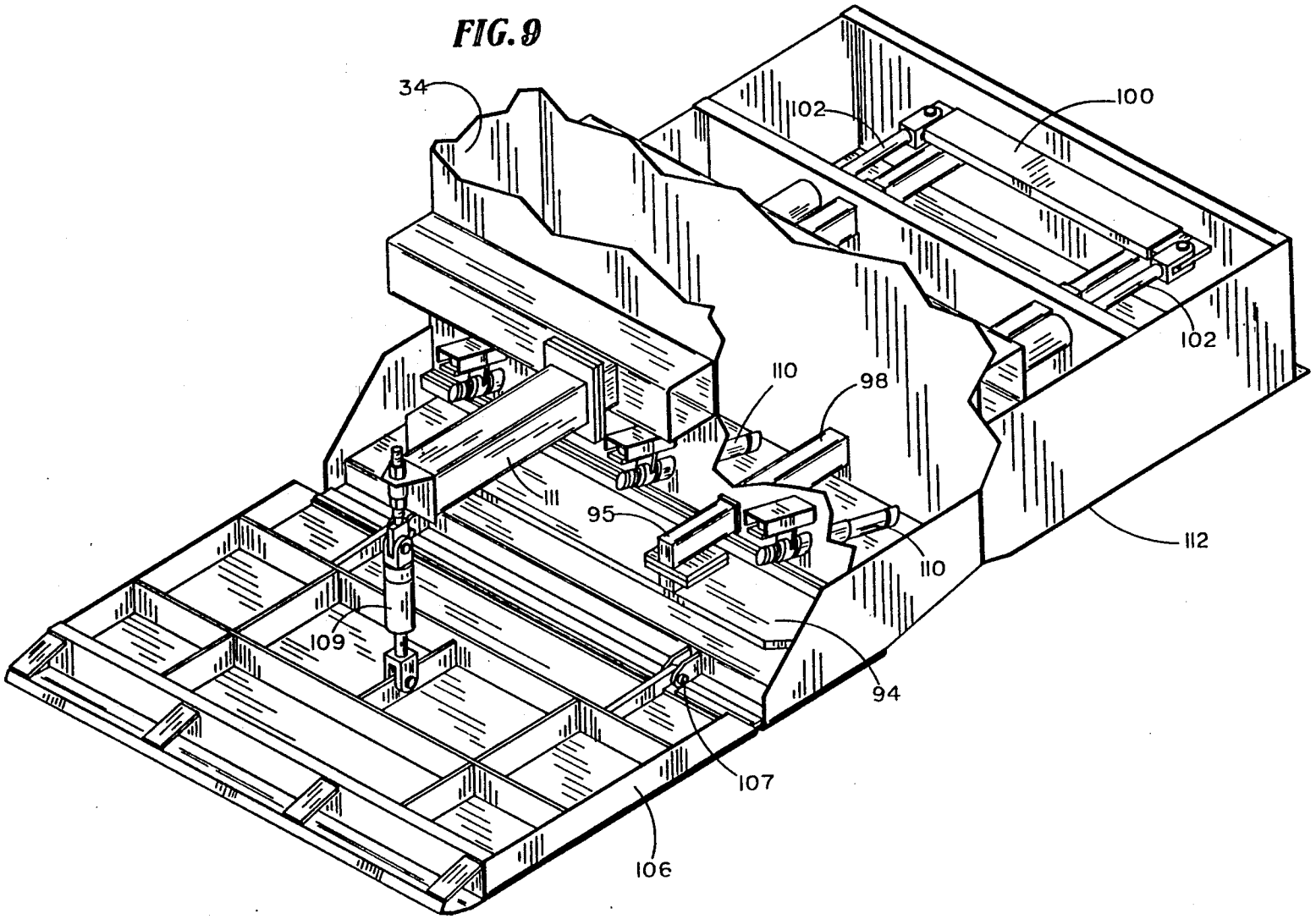
FIG. 9 is a perspective view of the lower end of the concrete laying apparatus.

The lower or discharge end 104 of the hopper 76 is selectively opened and closed by means of a horizontally moveable gate means 94 which is operatively connected to a plurality of horizontally slideable tubular frame members 95 that are telescopically received within tubes 98 secured to the hopper 76 as seen in FIGS. 8 and 9. One end of each of the frame members 95 is connected to a bar 100 and the opposite end thereof is secured to the gate means 94 as seen in FIG. 9. The bar 100 has a plurality of hydraulic cylinders 102 operatively connected thereto so that the bar 100 may be selectively horizontally moved. The selective horizontal movement of the bar 100 causes the gate 94 to be moved relative to the discharge end 104 of the hopper 76 between the positions illustrated in solid and broken line in FIG. 8 to selectively open and close the same. The head pressure of concrete in the hopper 76 exceeds the water pressure at the bottom of the canal so that concrete flows through the gate 94 when it is in its open position therefor without any backflow of water into the hopper 76.

Figure 7:
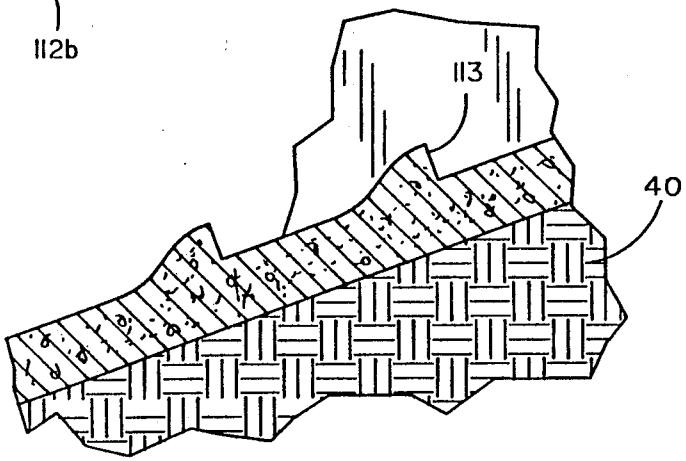
FIG. 7 is a detail sectional view illustrating the forming of steps in the concrete layer being applied to a sloped side portion of the canal bottom.

A surge plate 106 is provided below the gate means 94 and extends horizontally forwardly therefrom to prevent any "boiling up" of the canal bottom in the event it is soft in advance of the concrete being deposited on the canal bottom. The surge plate 106 is pivotally connected at 107 to the hopper means 76. The angular position of the surge plate 106 is permitted a limited range of floating movement by a surge plate cylinder 109 which is mounted at the forward end of a cantilevered beam 111 which extends forwardly from the forward wall 78 of the hopper 76. A plurality of hydraulic vibrators 110 are provided in the lower end of the hopper 76 to vibrate the concrete being applied to the canal bottom to ensure uniform density of the concrete being applied and to assist in the outflow of concrete through the discharge end 104 of the hopper 76. A screed 112 is provided at the lower end of the rearward wall 80 to apply the concrete uniformly on the canal bottom. Screed 112 is comprised of a flat section **112*a* which extends over the flat bottom portion of the canal and a sloped side portion 112*b* which extends over the sloped side wall portion of the canal. The horizontal portion 112*a* is flat to form a smooth finish to the concrete applied to the canal bottom. The sloped side wall portion 112*b* of the screed is provided with a plurality of notches 113 to form a plurality of animal escape steps 115 on the sides of the canal, as shown in FIGS. 6 and 7**.

Dam member 52 is pivotally connected at its upper end to frame means 12 at 114 (FIG. 5). A plurality of hydraulic cylinders 116 are connected to the frame means 12 and the dam member 52 so that the dam member 52 may be moved from an operative vertical position, illustrated by solid lines in FIG. 5, to an inoperative substantially horizontal position illustrated by broken lines in FIG. 5. The lower end of dam member 52 terminates at a point above the surface of the concrete which has been deposited or laid on the canal bottom.

Dam member 48 is connected at its upper end to the forward end of frame means 12 at 118. A plurality of hydraulic cylinders 120 permit the dam member 48 to be pivotally raised and lowered with respect to the frame means 12 as desired. A plurality of hydraulic cylinders 122 pivotally interconnect the frame means 12 with the dam member 48 to enable the dam member 48 to be pivotally moved between a vertical operating position and the substantially horizontal rest position illustrated in FIG. 1.

Dam member 50 is connected at its upper end to frame means 12 at 124 and is provided with a plurality of hydraulic cylinders 126 similar to cylinders 120 to enable dam member 50 to be moved relative to the frame means 12 and the canal bottom (FIGS. 2 and 3). A plurality of hydraulic cylinders 128 pivotally interconnect dam member 50 with frame means 12 to enable the dam member 50 to be pivotally moved between the substantially horizontal position illustrated in FIG. 2 to a vertical or hanging operative position. When the dam members 48, 50, and 52 are in their vertical positions, they cooperate to shield the lower end of the paving apparatus from water current in the canal.

To lay concrete on one-half of the canal bottom, the concrete hopper 76 is raised and then charged with concrete by way of the conveyor 84. The auger 82 is operated to distribute the concrete evenly in the hopper 76 to the appropriate level corresponding to the desired pressure head of concrete. The concrete laying apparatus is then lowered into position over approximately one-half of the canal bottom. The cylinders 90 and 124 are used to lower the concrete laying apparatus 44 to the appropriate vertical position centered relative to the frame 12. Sensors and/or visual observation by divers may be used to assure appropriate positioning.

The lining operation begins upon opening of the gate 94 and movement of the apparatus forwardly. The vibrators 110 are operated to assist in the flow of concrete of uniform density through the discharge end 104. Because the apparatus blocks only approximately one-half of the canal during operation, the water flow in the canal is not significantly affected. A layer of concrete is placed over the side wall 40 and the canal bottom to approximately the center line of the canal. Upon the return pass, wherein the apparatus is turned around and moving in the opposite direction, the concrete laying apparatus will be allowed to pour concrete completely to the edge of the previously laid concrete layer at the center of the canal bottom 38 to form a completely solid concrete layer over the canal bottom.

When the apparatus is to be shut down such as at the end of a shift or if the apparatus is to be turned around for a return pass, the gate 94 is closed and the vibrators 110 turned off. It is then necessary to remove the concrete from the hopper 76 before the same hardens therein. The hopper 76 is vertically moved upwardly by means of the hydraulic cylinders 90. A barge or other suitable means is then moved into position beneath the concrete hopper 76. The gates 94 are then opened to permit any concrete in the hopper 76 to flow downwardly therefrom into the barge or other receptacle.

Whereas the machine of the present invention has been shown and described in connection with the preferred embodiment thereof, it will be understood that modifications, substitutions, and additions may be made therein which are within the intended scope of the appended claims.

We claim:

1. A concrete paving machine for applying a concrete layer over the bottom of a water-filled irrigation canal having a bottom formed with a generally horizontal center section and outwardly and upwardly inclined end sections comprising:

(a) an elongated portable frame means of a length to span the canal;

(b) means on opposite ends of the frame means for propelling the frame means along the canal;

(c) a hopper for a concrete material extended longitudinally of and movably supported on said frame means for up and down movement having a generally horizontally disposed inner section and an outwardly and upwardly inclined outer section, with said inner section and said outer section conforming to the angular relation of the center section and end section of the canal bottom and positioned thereover;

(d) upright baffle means spaced longitudinally of and supported within said hopper to form a series of hopper units, each of which has an open bottom;

(e) an auger unit extended horizontally of said hopper above said baffle means for maintaining concrete material supplied to the hopper at a predetermined level therein, providing a concrete material head pressure over the length of the hopper which is greater than the water head pressure in the canal over such length;

(f) a movable closure means for the bottom of each of said hopper units, said closure means being in closed positions therefor and said hopper means in a raised position above the water in said canal when the hopper is initially supplied with concrete material to said predetermined level, and in open positions therefor when the hopper is in a lowered position in the canal for applying a concrete layer over an end section and a portion of the central section of the canal bottom as the frame is propelled along the canal; and (g) means for substantially shielding the hopper from water current in the canal as the layer of concrete material is being applied.

2. The concrete paving machine, according to claim 1, including:

(a) a screed unit extended rearwardly from the open bottoms of said hopper units to maintain a substantially uniform thickness of the concrete material being applied on the canal bottom.

3. The concrete paving machine, according to claim 2, wherein:

(a) said screed unit includes an inner substantially horizontally disposed portion having a continuous flat bottom surface, and an outer, upwardly and outwardly inclined outer section having a bottom surface formed with a series of transverse longitudinally spaced notches for forming steps in the concrete layer being applied to an inclined end section of the canal bottom.

4. The concrete paving machine, according to claim 2, including:

(a) a surge plate positioned forwardly of the open bottom closely adjacent to the canal bottom to reduce deformation of the canal bottom that may result from the discharge of concrete material from said hopper units; and (b) means for applying a yieldable pressure on said surge plate to maintain a generally constant vertical spacing between the lower surface of the screed unit and the surface of the canal bottom to provide a substantially constant thickness to the concrete layer being applied.

5. The concrete paving machine, according to claim 1, including:

(a) a vibrator unit located within each hopper unit above the open bottom thereof to provide a uniform density of the concrete material discharged from said opening for application to the canal bottom.

6. The concrete paving machine, according to claim 1, including:

(a) means on said frame for moving said closure means in unison between the opened positions and closed positions therefor.

* * * * *